US005278569A

United States Patent [19]

Ohta et al.

[11] Patent Number: 5,278,569

[45] Date of Patent: Jan. 11, 1994

[54] PLANE ANTENNA WITH HIGH GAIN AND ANTENNA EFFICIENCY

[75] Inventors: Masahiko Ohta; Hironori Ishizaka, both of Shimodate; Hisayoshi Mizugaki, Ibaragi, all of Japan

[73] Assignee: Hitachi Chemical Company, Ltd., Tokyo, Japan

[21] Appl. No.: 931,112

[22] Filed: Aug. 17, 1992

Related U.S. Application Data

[63] Continuation of Ser. No. 732,804, Jul. 19, 1991, abandoned.

[30] Foreign Application Priority Data

Jul. 25, 1990 [JP] Japan ..... 2-196903

[51] Int. Cl.[5] ..... H01Q 1/38

[52] U.S. Cl. ..... 343/700 MS; 343/846

[58] Field of Search ..... 343/700 MS, 829, 846, 770, 769, 767

[56] References Cited

U.S. PATENT DOCUMENTS

| | | | |
|---|---|---|---|
| 3,832,716 | 8/1974 | Plunk | 343/770 |
| 4,426,649 | 1/1984 | Dubost | 343/700 MS |
| 4,623,893 | 11/1986 | Sabban | 343/700 MS |
| 4,761,654 | 8/1988 | Zaghloul | 343/700 MS |
| 4,792,810 | 12/1988 | Fukuzawa et al. | 343/700 MS |
| 4,816,835 | 3/1989 | Abiko et al. | 343/700 MS |
| 4,843,400 | 6/1989 | Tsao et al. | 343/700 MS |
| 4,857,938 | 8/1989 | Tsukamoto et al. | 343/700 MS |
| 4,922,263 | 5/1990 | Dubost | 343/700 MS |
| 4,977,406 | 12/1990 | Tsukamoto | 343/700 MS |

FOREIGN PATENT DOCUMENTS

| | | |
|---|---|---|
| 0207029 | 12/1986 | European Pat. Off. . |
| 0345454 | 12/1989 | European Pat. Off. . |
| 0414266 | 2/1991 | European Pat. Off. . |
| 55-128903 | 10/1980 | Japan . |

OTHER PUBLICATIONS

IEEE Transactions on Broadcasting, vol. 34, No. 4, Dec. 1988, pp. 457–464.

*Primary Examiner*—Donald Hajec
*Assistant Examiner*—Hoanganh Le
*Attorney, Agent, or Firm*—Jones & Askew

[57] ABSTRACT

A plane antenna with high gain and antenna efficiency. The antenna includes an antenna unit comprising: a first dielectric body; a first grounding conductor body provided on a lower side of the first dielectric body; a current supply line in a form of a strip line provided on an upper side of the first dielectric body; a patch shaped radiative element provided on the upper side of the first dielectric body at an end of the current supply line; a second dielectric body formed on the upper side of the first dielectric body over the radiative element and the current supply line; and a second grounding conductor body provided on the upper side of the second dielectric body, which has a slot at a position located directly above the radiative element; wherein the radiative elements and the slots of the plane antenna are arranged in a planar array with a constant interval in two orthogonal directions, where the constant interval has a value equal to 0.72 to 0.93 or more preferably 0.85 to 0.93 times a wavelength corresponding to a central frequency of a frequency band for waves to be used.

12 Claims, 9 Drawing Sheets

PLANE ANTENNA WITH HIGH GAIN AND ANTENNA EFFICIENCY

This is a continuation of application Ser. No. 07/732,804, filed Jul. 19. 1991, now abandoned.

BACKGROUND OF THE INVENTION

1. Field of the Invention

The present invention relates to a microstrip type plane antenna to be utilized in microwave communication.

2. Description of the Background Art

A plane antenna has been developed as an alternative to a parabola antenna for microwave communication.

As an example of such a plane antenna, there is a microstrip type plane antenna shown in FIGS. 1(A) and 1(B), where the antenna comprises: a dielectric body 2; a grounding conductor body 1 provided on a lower side of the dielectric body 2; a current supply line 5 in a form of a strip line provided on an upper side of the dielectric body 2; and a patch shaped radiative element 4 provided on the upper side of the dielectric body 2 at an end of the current supply line 5. The antenna for practical use actually has a plurality of the patch shaped radiative elements 4 arranged in an array, among which the current supply lines 5 are arranged with their lengths, branching positions, and line widths appropriately adjusted for the sake of phase matching and impedance matching.

However, in this type of a microstrip type plane antenna, the current supply lines 5 are exposed on the radiation plane, so that there are unnecessary radiations radiated from branching and curving sections of the current supply lines 5. As a result, the radiation characteristic has been rather low in this type of a microstrip type plane antenna.

As an improvement on such a conventional microstrip type plane antenna, there has been a proposition of a microstrip type plane antenna shown in FIGS. 2(A) and 2(B), where the antenna comprises: a first dielectric body 2; a first grounding conductor body 1 provided on a lower side of the first dielectric body 2; a current supply line 5 in a form of a strip line provided on an upper side of the first dielectric body 2; a patch shaped radiative element 4 provided on the upper side of the first dielectric body 2 at an end of the current supply line 5; a second dielectric body 21 formed on the upper side of the first dielectric body 2 over the radiative element 4 and the current supply line 5; and a second grounding conductor body 11 provided on the upper side of the second dielectric body 21, which has a slot 3 at a position located directly above the radiative element 4.

In a microstrip type plane antenna formed from a plurality of such antenna units arranged in an array, the current supply lines 5 are arranged in a space sandwiched between the first and second grounding conductor bodies 1 and 11, so that the unnecessary radiations from the branching and curving sections of the current supply lines 5 tend to be suppressed by being obstructed by the second grounding conductor body 11 while the radiations from the radiative elements 4 can be transmitted without any obstruction through the slots 3 as shown in FIG. 2(C), such that the antenna efficiency can be improved.

Although this microstrip type plane antenna is effective in suppressing the unnecessary radiations from the current supply lines, it is also associated with a problem that the radiation efficiency of this antenna becomes low when the area of the slot 3 is small such that the gain is lower by 1 to 4 dB compared with the antenna of FIGS. 1(A) and 1(B). If the area of the slot 3 is increased, the gain may be improved, but the effect of suppressing the unnecessary radiations from the current supply line would be weakened such that the antenna gain becomes low.

SUMMARY OF THE INVENTION

It is therefore an object of the present invention to provide a plane antenna with high gain and antenna efficiency.

According to one aspect of the present invention there is provided a plane antenna formed by a plurality of antenna units arranged in an array, each of the antenna units comprising: a first dielectric body; a first grounding conductor body provided on a lower side of the first dielectric body; a current supply line in a form of a strip line provided on an upper side of the first dielectric body; a patch shaped radiative element provided on the upper side of the first dielectric body at an end of the current supply line; a second dielectric body formed on the upper side of the first dielectric body over the radiative element and the current supply line; and a second grounding conductor body provided on the upper side of the second dielectric body, which has a slot at a position located directly above the radiative element; wherein the radiative elements and the slots of the plane antenna are arranged in a planar array with a constant interval in two orthogonal directions, where the constant interval has a value equal to 0.72 to 0.93 times a wavelength corresponding to a central frequency of a frequency band for waves to be used.

According to another aspect of the present invention there is provided an array antenna formed by a plurality of plane antennas arranged in an array, each of the plane antennas being formed by a plurality of antenna units arranged in an array, each of the antenna units comprising: a first dielectric body; a first grounding conductor body provided on a lower side of the first dielectric body; a current supply line in a form of a strip line provided on an upper side of the first dielectric body; a patch shaped radiative element provided on the upper side of the first dielectric body at an end of the current supply line; a second dielectric body formed on the upper side of the first dielectric body over the radiative element and the current supply line; and a second grounding conductor body provided on the upper side of the second dielectric body, which has a slot at a position located directly above the radiative element; wherein the radiative elements and the slots of the plane antenna are arranged in a planar array with a constant interval in two orthogonal directions, where the constant interval has a value equal to 0.72 to 0.93 times a wavelength corresponding to a central frequency of a frequency band for waves to be used.

Other features and advantages of the present invention will become apparent from the following description token in conjunction with the accompanying drawings.

DETAILED DESCRIPTION OF THE PREFERRED EMBODIMENTS

Figure 1:
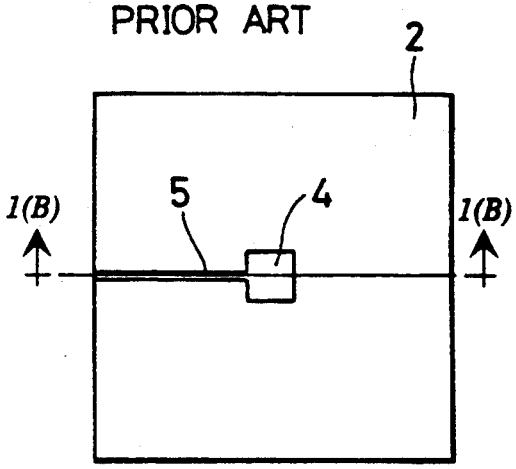
FIG. 1 (A) PRIOR ART
FIGS. 1(A) and 1(B) are a top plan view and a cross sectional view, respectively, of an example of a conventional microstrip type plane antenna.
Figure 2:
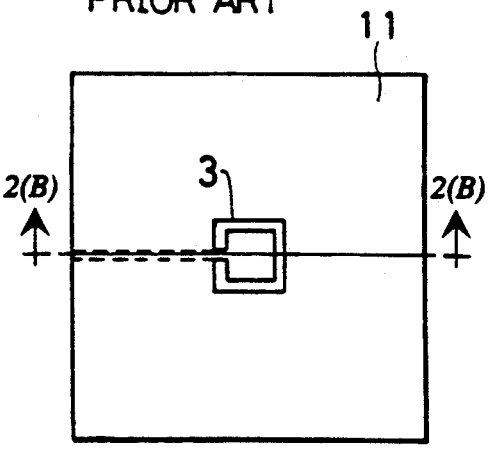
FIG. 2 (A) PRIOR ART
FIGS. 2(A) and 2(B) are a top plan view and a cross sectional view, respectively, of another example of a conventional microstrip type plane antenna.
FIG. 2(C) is a cross sectional view of a conventional microstrip type plane antenna constructed from antenna units in a form shown in FIGS. 2(A) and 2(B).
Figure 1:
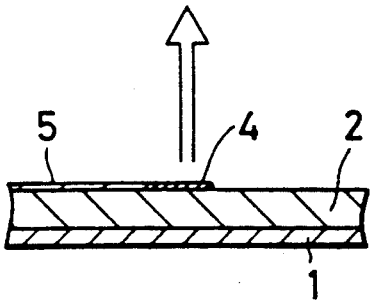
FIG. 1 (B) PRIOR ART
Figure 2:
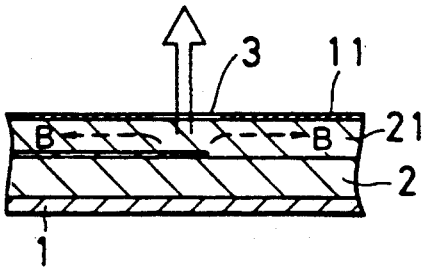
FIG. 2 (B) PRIOR ART
Figure 2:
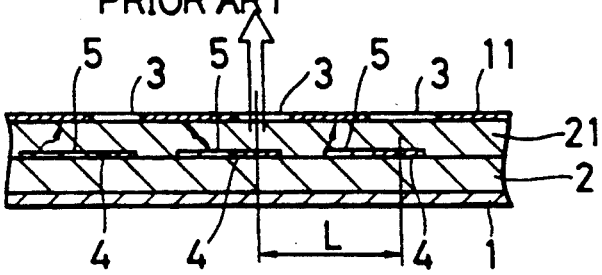
FIG. 2 (C) PRIOR ART
Figure 3:
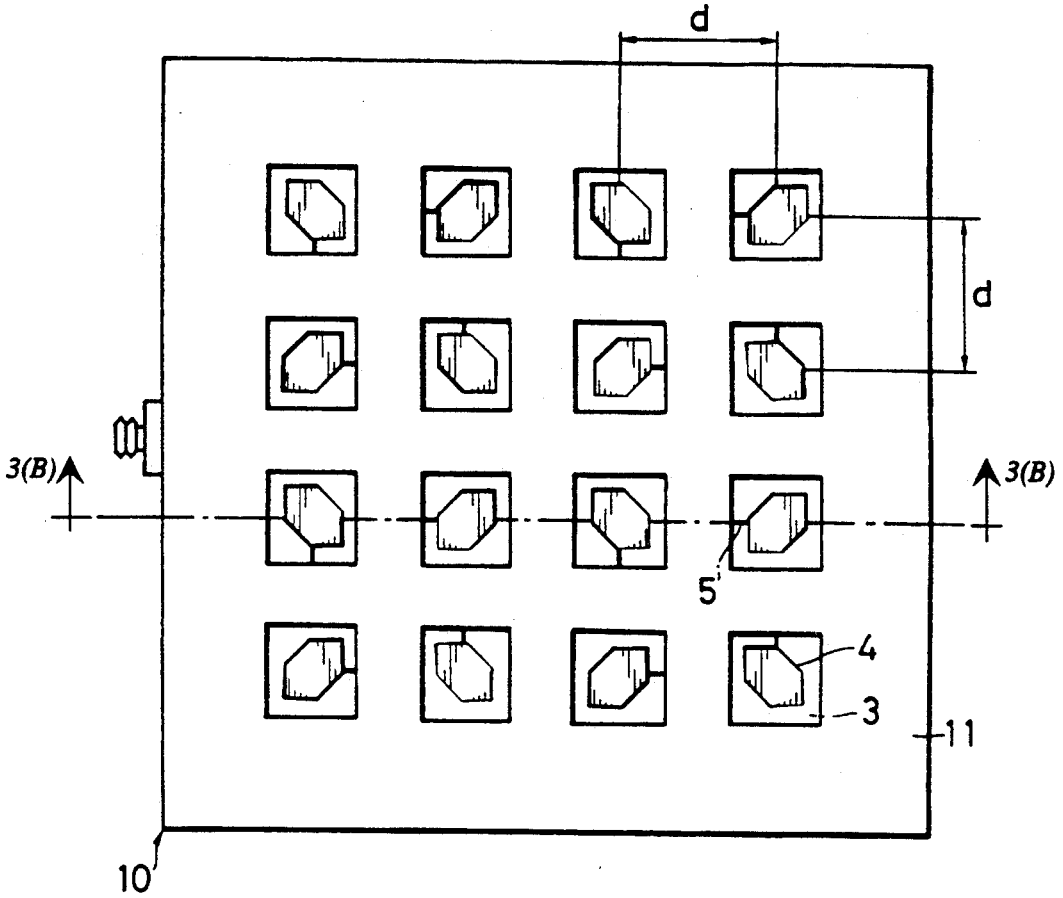
FIGS. 3(A) and 3(B) are a top plan view and a cross sectional view, respectively, of a first embodiment of a microstrip type plane antenna according to the present invention.
Figure 3:
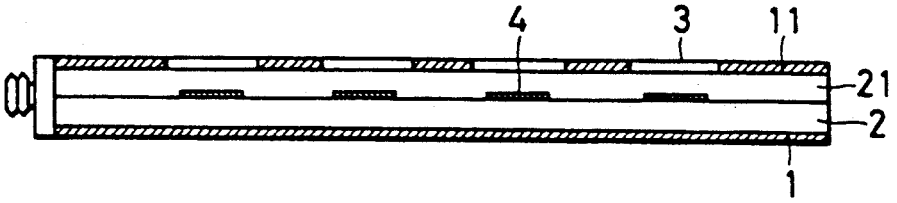

Referring now to FIGS. 3(A) and 3(B), a first embodiment of a microstrip type plane antenna according to the present invention will be described in detail.

In this first embodiment shown in FIGS. 3(A) and 3(B), a microstrip type plane antenna 10 is formed from a plurality of antenna units arranged in an array, each of which comprises: a first dielectric body 2; a first grounding conductor body 1 provided on a lower side of the first dielectric body 2; a current supply line 5 in-a form of a strip line provided on an upper side of the first dielectric body 2; a patch shaped radiative element 4 provided on the upper side of the first dielectric body 2 at an end of the current supply line 5; a second dielectric body 21 formed on the upper side of the first dielectric body 2 over the radiative element 4 and the current supply line 5; and a second grounding conductor body 11 provided on the upper side of the second dielectric body 21, which has a slot 3 at a position located directly above the radiative element 4.

In this microstrip type plane antenna 10, the radiative elements 4 and the slots 3 are arranged in a planar array with a constant interval d in both of longitudinal and transverse directions, where a value of this interval d is set equal to 0.72 to 0.93 or more preferably 0.85 to 0.93 times a wavelength $\lambda_0$ corresponding to a central frequency of a frequency band for the waves to be transmitted or received by this microstrip type plane antenna 10, for the following reason.

Figure 4A:
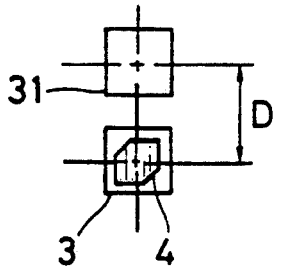
FIGS. 4(A) and 4(B) are top plan views of two configurations of adjacent slots for which a relationship between the gain and the relative slot pitch is examined.
Figure 4B:
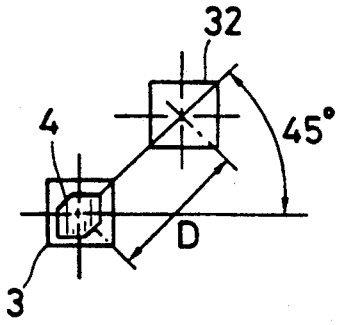

Namely, the present inventors conducted an experiment to determine a relationship between a relative slot pitch $D/\lambda_0$ and the radiation gain for two cases shown in FIGS. 4(A) and 4(B). In a case shown in FIG. 4(A), the radiative element 4 has one slot 3 located directly above it and another slot 31 located at a distance D from the slot 3 in a longitudinal or a transverse direction, while in a case shown in FIG. 4(B), the radiative element 4 has one slot 3 located directly above it and another slot 32 located at a distance D from the slot 3 in a diagonal direction.

Figure 5:
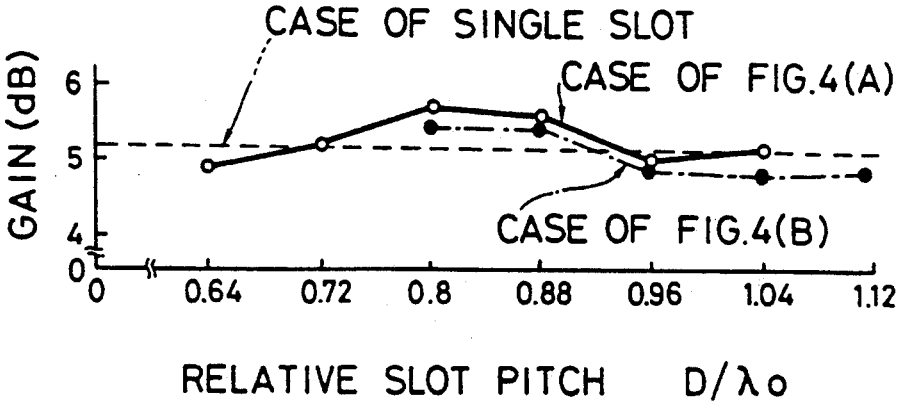
FIG. 5 is a graph of a relationship between the gain and the relative slot pitch obtained for the two configurations of FIGS. 4(A) and 4(B).

The result obtained by this experiment is shown in FIG. 5 along with a case in which the radiative element 4 has only one slot 3 located directly above it. According to this result shown in FIG. 5, it can be observed that the gain for the case of FIG. 4(A) or the case of FIG. 4(B) becomes greater than the case of using a single slot only for the relative slot pitch $D/\lambda_0$ within a range of 0.72 to 0.93.

This result implies that the phase of the waves radiated from the slot 31 or 32 and the phase of the waves radiated from the slot 3 are substantially aligned with each other only for the relative slot pitch $D/\lambda_0$ within a range of 0.72 to 0.93, and that the gain is affected by the phase difference between these waves for the relative slot pitch D/lo outside of this range.

Figure 6:
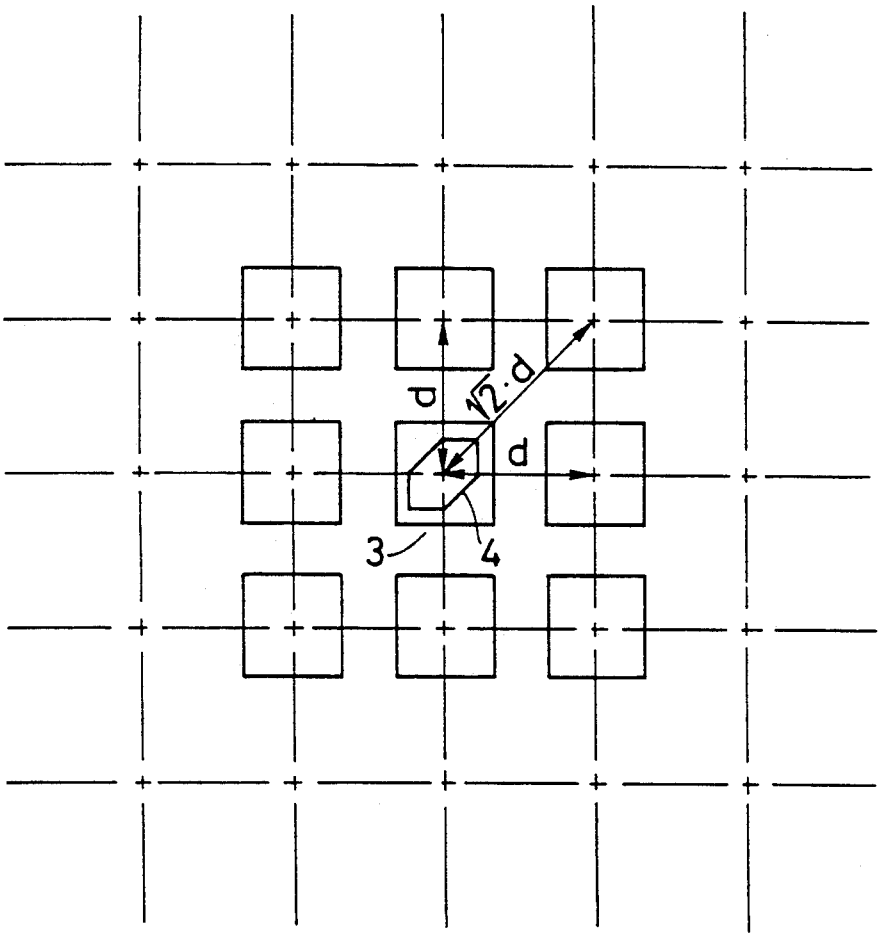
FIG. 6 is a top plan view of a configuration of neighboring slots for which a relationship between the gain and the relative slot pitch is evaluated.

On a basis of this observation, a case shown in FIG. 6 in which the radiative element 4 has one slot 3 located directly above it and eight other slots neighboring to this slot 3 in the longitudinal, transverse, and diagonal directions is considered, and a range of the relative slot pitch $D/\lambda_0$ for which the gain can be greater than that obtained by a single slot and for which the antenna efficiency can be greater than 60% is evaluated to be a range of 0.85 to 0.93.

For this reason, this range is selected as an appropriate one for the interval d between the slots 3 in the first embodiment shown in FIGS. 3(A) and 3(B). Thus, in this first embodiment, the radiative elements 4 and the slots 3 are arranged in an array with such an interval for which the phase of the waves radiated from one slot can be aligned with the phase of the waves radiated from adjacent slots, so that it becomes possible to realize a high antenna gain while retaining a feature to suppress the unnecessary radiation from the current supply lines for the sake of the antenna efficiency.

Also, in this first embodiment, the shape of each slot 3 is selected to be a square having a length of each side equal to 0.48 to 0.65 times a wavelength lo corresponding to a central frequency of a frequency band for the waves to be transmitted or received by this microstrip type plane antenna 10, for the following reason.

Namely, the present inventors also conducted an experiment to determine a relationship of a relative slot size $l/\lambda_0$ with respect to the gain per antenna including 384 radiative elements which is indicated by an upper curve, or with respect to the gain per single radiative element which is indicated by a lower curve.

Figure 7:
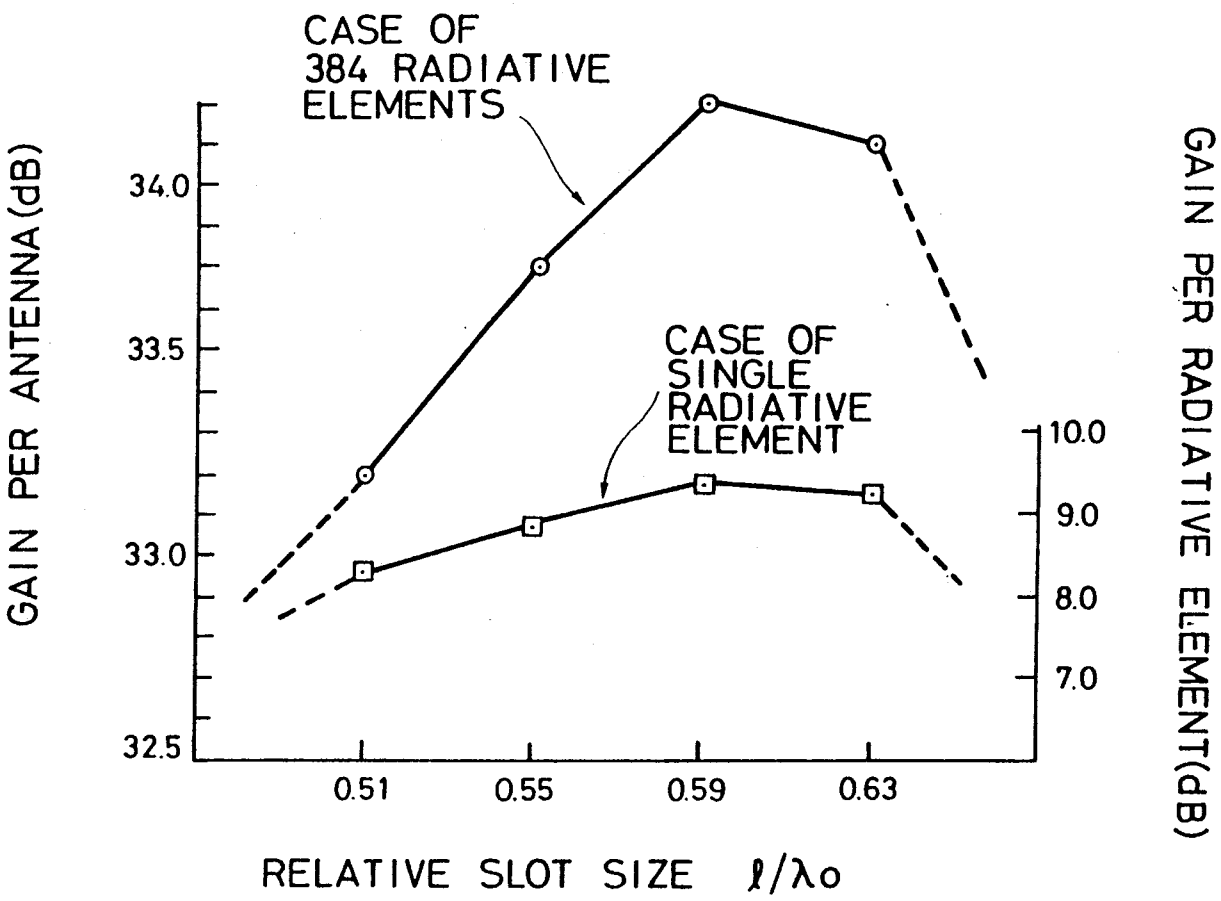
FIG. 7 is a graph of a relationship between the gain and the relative slot size obtained for an antenna and for a single radiative element.

The result obtained by this experiment is shown in FIG. 7, from which it can be observed that the gain per single radiative element becomes greater than a conventionally attainable 8 dB for the relative slot size $l/\lambda_0$ within a range of 0.48 to 0.65, with a peak at a value approximately equal to 0.59.

For this reason, this range is selected as an appropriate one for the slot size of the slots 3 in the first embodiment shown in FIGS. 3(A) and 3(B). Thus, the antenna efficiency in this first embodiment can be further improved by adopting the slot size within this range.

Here, it is to be noted that the shape of each slot 3 may be selected to be a circular disk having a diameter equal to 0.48 to 0.65 times a wavelength $\lambda_0$ corresponding to a central frequency of a frequency band for the waves to be transmitted or received by this microstrip type plane antenna 10, instead of the square shape as described above and depicted in the drawings.

Figure 8A:
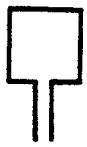
FIGS. 8(A) to 8(F) are illustration of various possible shapes for the radiative element in the microstrip type plane antenna of FIGS. 3(A) and 3(B).
Figure 8B:
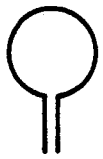
Figure 8C:
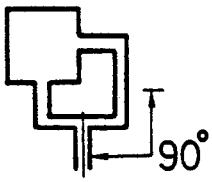
Figure 8D:
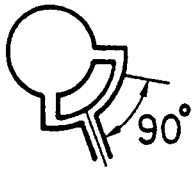
Figure 8E:
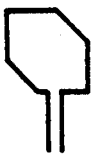
Figure 8F:
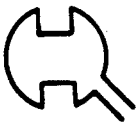

It is also to be noted that the shape of each radiative element 4 in this first embodiment can be selected from various shapes shown in FIGS. 8(A) to 8(F). In a case of dealing with linearly polarized waves, the patch shaped radiative element of a square shape as shown in FIG. 8(A) or of a circular disk shape as shown in FIG., 8(B) may be employed. In a case of dealing with circularly polarized waves, the two-point current supply type radiative element of a square shape as shown in FIG. 8(C) or of a circular disk shape as shown in Fig, 8(D), to which two current supply lines with 900 phase difference are attached, may be employed. Also, in this case, the one-point current supply type radiative element incorporating a so called perturbation in which a ratio with respect to the longitudinal and transverse directions is altered, such as those shown in FIG. 8(E) and FIG. 8(F) may be employed instead.

More specifically, the microstrip type plane antenna 10 of this first embodiment has been actually constructed as follows.

In a configuration shown in FIGS. 3(A) and 3(B), the first grounding conductor body 1 is formed from an aluminum plate of 140 mm $\times$140 mm size and 3 mm thickness. The first dielectric body 2 is formed from a polyethylene foam of 2 mm thickness having the relative dielectric constant approximately equal to 1.1 which is covered on its upper side by a substrate formed by a copper foil attached to a polyethylene film of 25 $\mu$m thickness, where the antenna circuit including the radiative elements 4 and the current supply lines 5 are formed on this substrate by etching off the unnecessary parts of the copper foil from the substrate. The second dielectric body 21 is formed from a polyethylene foam of 2 mm thickness having the relative dielectric constant approximately equal to 1.1, and the second grounding conductor body 11 is formed from an aluminum plate of 0.5 mm thickness, on which the slots 3 are formed at positions located directly above the radiative elements 4.

Here, a number of the radiative elements 4 and a number of slots 3 are sixteen respectively, and these sixteen radiative elements 4 and sixteen slots 3 are arranged in a planar array with a constant interval d in both of longitudinal and transverse directions, where a value of this interval d is set equal to 0.89 times a wavelength $\lambda_0 = 11.85$ GHz corresponding to a central frequency of a frequency band for the waves to be transmitted or received by this microstrip type plane antenna 10, while the shape of each slot 3 is selected to be a square having a length of each side equal to 0.51 times the aforementioned wavelength $\lambda_0$, which takes a value of 13 mm.

The measured antenna gain of this microstrip type plane antenna was 19.5 dB, according to which the gain per single radiative element has been improved by approximately 3 dB compared with a case of the radiative element having only one slot directly above it.

Figure 9:
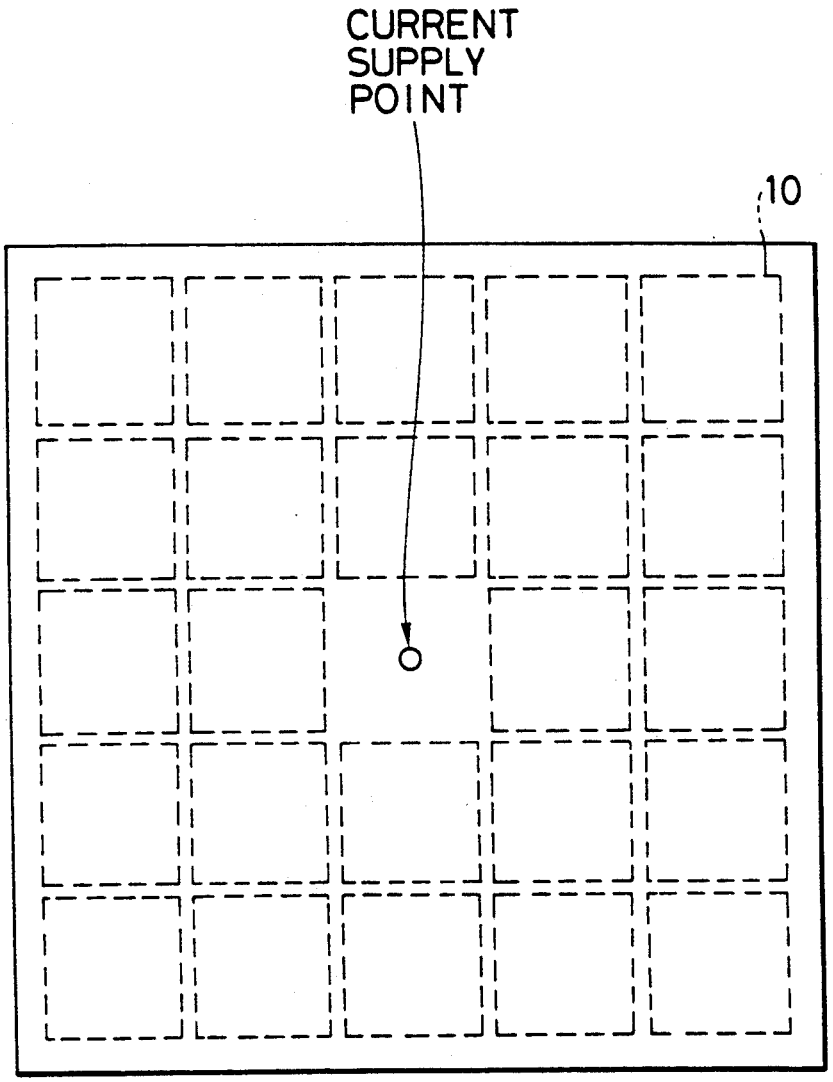
FIG. 9 is a top plan view of an array antenna formed by arranging a plurality of the microstrip type plane antennas of FIGS. 3(A) and 3(B) in an array.

Also, twenty-four of the antennas with a configuration of FIGS. 3(A) and 3(B) just described above are arranged in a square array as shown in FIG. 9, with a current supply point located at a center of the square array to form an array antenna. The measured antenna gain of this array antenna was 33.2 dB, according to which the gain per single radiative element has been improved by approximately 3.3 dB compared with a case of the radiative element having only one slot directly above it.

In addition, the antenna with a configuration similar to that shown in FIGS. 3(A) and 3(B) except that the shape of each slot 3 is selected to be a circular disk having a diameter equal to 0.51 times the aforementioned wavelength $\lambda_0$ was also constructed, and the result similar to that obtained by the configuration of FIGS. 3(A) and 3(B) were also obtained.

Figure 10:
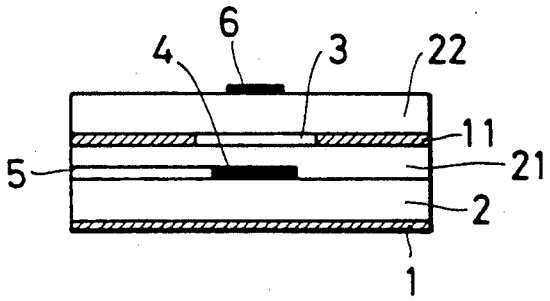
FIGS. 10(A) and 10(B) are a cross sectional view and a top plan view, respectively, of a second embodiment of a microstrip type plane antenna according to the present invention.
Figure 10:
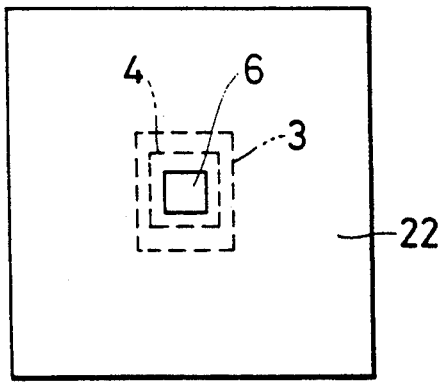

Referring now to FIGS. 10(A) and 10(B), a second embodiment of a microstrip type plane antenna according to the present invention will be described in detail.

In this second embodiment shown in FIGS. 10(A) and 10(B), a microstrip type plane antenna is formed from a plurality of antenna units arranged in an array, each of which comprises: a first dielectric body 2; a first grounding conductor body 1 provided on a lower side of the first dielectric body 2; a current supply line 5 in a form of a strip line provided on an upper side of the first dielectric body 2; a patch shaped radiative element 4 provided on the upper side of the first dielectric body 2 at an end of the current supply line 5; a second dielectric body 21 formed on the upper side of the first dielectric body 2 over the radiative element 4 and the current supply line 5; a second grounding conductor body 11 provided on the upper side of the second dielectric body 21, which has a slot 3 at a position located directly above the radiative element 4; a third dielectric body 22 formed on the upper side of the second grounding conductor body 11; and a passive element 6 provided on the upper side of the third dielectric body 22 at a position directly above the slot 3.

In this microstrip type plane antenna, the radiative elements 4 and the slots 3 are arranged in a planar array with a constant interval d in both of longitudinal and transverse directions, where a value of this interval d is set equal to 0.72 to 0.93 or more preferably 0.85 to 0.93 times a wavelength ko corresponding to a central frequency of a frequency band for the waves to be transmitted or received by this microstrip type plane antenna, as in the first embodiment described above.

Also, in this second embodiment, the shape of each slot 3 is selected to be a square having a length of each side equal to 0.48 to 0.65 times a wavelength $\lambda_0$ corresponding to a central frequency of a frequency band for the waves to be transmitted or received by this microstrip type plane antenna 10, as in the first embodiment described above.

The additional feature of the passive element 6 in this second embodiment has the following effect.

Namely, the present inventors conducted an experiment to determine a relationship of a relative slot size $l/\lambda_0$ and the gain for a case using the passive element 6 and a case not using the passive element 6.

Figure 11:
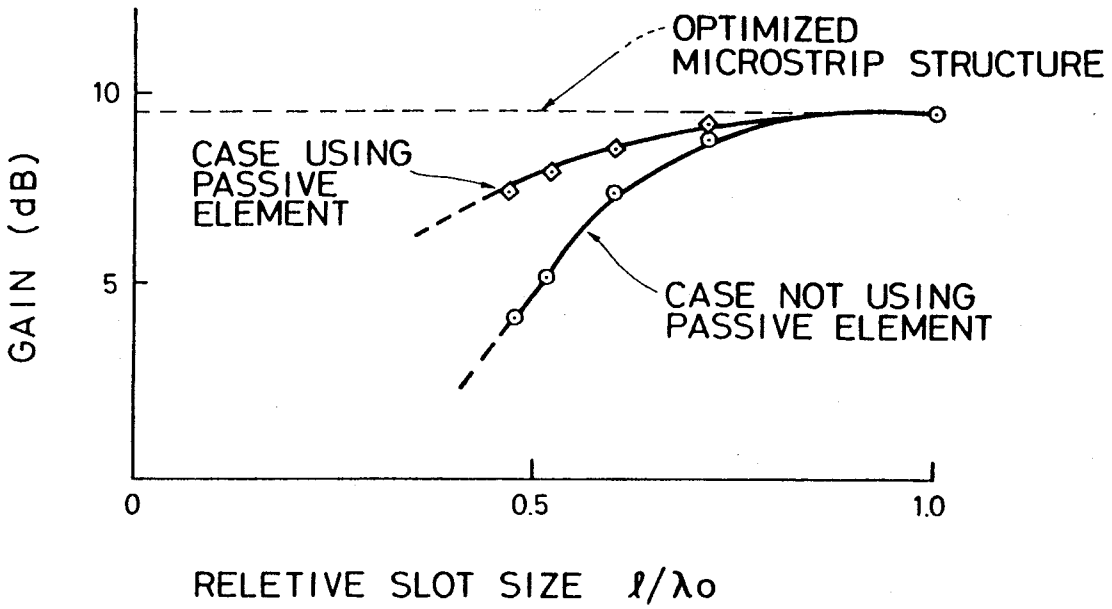
FIG. 11 is a graph of a relationship between the gain and the relative slot size obtained for a case using the passive element and for a case not using the passive element.

The result obtained by this experiment is shown in FIG. 11 along with a case of using an optimized microstrip structure, from which it can be observed that the gain becomes greater for the case using the passive element 6 compared with the case not using the passive element 6, for smaller slot sizes.

Here, it is to be noted that the shape of each passive element 6 in this second embodiment can be selected to be any shape used for the usual radiative element, such as a square shape or a circular disk shape.

More specifically, the microstrip type plane antenna of this second embodiment has been actually constructed as follows.

In addition to the specific construction of the microstrip type plane antenna 10 of the first embodiment described above, the third dielectric body 22 is formed from a polyethylene foam of 2 mm thickness having the relative dielectric constant approximately equal to 1.1 which is covered on its upper side by a substrate formed by a copper foil attached to a polyethylene film of 25 μm thickness, where the passive element 6 is formed on this substrate by etching off the unnecessary parts of the copper foil from the substrate at a position located directly above the slot 3 and the radiative element 4.

The value of the interval d is set equal to 0.89 times a wavelength $\lambda_0=11.85$ GHz corresponding to a central frequency of a frequency band for the waves to be transmitted or received by this microstrip type plane antenna, while the shape of each slot 3 is selected to be a square having a length of each side equal to 0.51 times the aforementioned wavelength $\lambda_0$, which takes a value of 13 Mm, as in the case of the first embodiment described above.

With this microstrip type plane antenna of the second embodiment, the result similar to that obtained by the configuration of FIGS. 3(A) and 3(B) were also obtained.

Thus, in this second embodiment, the antenna efficiency in of the microstrip type plane antenna can be further improved by using the additional passive element.

Figure 12:
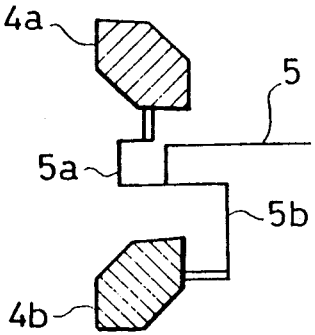
FIG. 12 is a schematic diagram for a possible arrangement in pair of two radiative elements in the microstrip type plane antenna according to the present invention.

It is to be noted that the radiative elements 4 in the above described embodiments may be arranged in units of pairs, as shown in FIG. 12. Namely, one radiative element 4*a* and another a adjacent radiative element 4*b* may be arranged such that the radiative element 4*a* is rotated by 90° with respect to the radiative element 4*b*, and the radiative element 4*a* is connected to the common single current supply line 5 through branch 5*a* while the radiative element 4*b* is connected to the common single current supply line 5 through another branch 5*b* which is longer than the branch 5*a* such that the phases from the radiative elements 4*a* and 4*b* can be matched at the common single current supply line 5.

It is also to be noted that, besides those already mentioned above, many modifications and variations of the above embodiments may be made without departing from the novel and advantageous features of the present invention. Accordingly, all such modifications and variations are intended to be included within the scope of the appended claims.

What is claimed is:

1. A plane antenna formed by a plurality of antenna units arranged in an array, each of the antenna units comprising;

a first dielectric body;

a first grounding conductor body provided on a lower side of the first dielectric body;

a current supply line in the form of a strip line provided on an upper side of the first dielectric body;

a patch shaped radiative element provided on the upper side of the first dielectric body at an end of the current supply line;

a second dielectric body formed on the upper side of the first dielectric body over the radiative element and the current supply line;

a second grounding conductor body provided on the upper side of the second dielectric body, which has a slot at a position located directly above the radiative element; and wherein the radiative elements and the slots of the plane antenna are arranged in a planar array with a constant interval in two orthogonal directions and each radiative elements is in radiative communication with all the slots of the plane antenna through the second dielectric body which is commonly provided for all the antenna units of the plane antenna, where the constant interval has a value equal to 0.72 to 0.93 times a wavelength corresponding to a central frequency of a frequency band for waves to be used.

2. The plane antenna of claim 1, wherein the constant interval of the planar array has a value equal to 0.85 to 0.93 times the wavelength corresponding to the central frequency of the frequency band for waves to be used.

3. The plane antenna of claim 1, wherein the slot of each antenna unit is in a square shape having a length of each side equal to 0.48 to 0.65 times the wavelength corresponding to the central frequency of the frequency band for the waves to be used.

4. The plane antenna of claim 1, wherein the slot of each antenna unit is in a circular disk shape having a diameter equal to 0.48 to 0.65 times the wavelength corresponding to the central frequency of the frequency band for the waves to be used.

5. The plane antenna of claim 1, wherein each antenna unit further comprises:

a third dielectric body formed on the upper side of the second grounding conductor body; and a passive element provided on the upper side of the third dielectric body at a position directly above the slot.

6. The plane antenna of claim 1, wherein the radiative elements of the plane antenna are arranged in units of pairs.

7. An array antenna formed by a plurality of plane antennas arranged in an array, each of the plane antennas being formed by a plurality of antenna units arranged in an array, each of the antenna units comprising:

a first dielectric body;

a first grounding conductor body provided on a lower side of the first dielectric body;

a current supply line in the form of a strip line provided on an upper side of the first dielectric body;

a patch shaped radiative element provided on the upper side of the first dielectric body at an end of the current supply line;

a second dielectric body formed on the upper side of the first dielectric body over the radiative element and the current supply line;

a second grounding conductor body provided on the upper side of the second dielectric body, which has a slot at a position located directly above the radiative element; and wherein the radiative elements and the slots of the plane antenna are arranged in a plannar array with a constant interval in two orthogonal directions and each radiative element is in radiative communication with all the slots of the plane antenna through the second dielectric body which is commonly provided for all the antenna units of the plane antenna, where the constant interval has a value equal to 0.72 to 0.93 times a wavelength corresponding to a central frequency of a frequency band for waves to be used.

8. The plane antenna of claim 7, wherein the constant interval of the planar array has a value equal to 0.85 to 0.93 times the wavelength corresponding to the central frequency of the frequency band for waves to be used.

9. The array antenna of claim 7, wherein the slot of each antenna unit is in a square shape having a length of each side equal to 0.48 to 0.65 times the wavelength corresponding to the central frequency of the frequency band for the waves to be used.

10. The array antenna of claim 7, wherein the slot of each antenna unit is in a circular disk shape having a diameter equal to 0.48 to 0.65 times the wavelength corresponding to the central frequency of the frequency band for the waves to be used.

11. The array antenna of claim 7, wherein each antenna unit further comprises:

a third dielectric body formed on the upper side of the second grounding conductor body; and a passive element provided on the upper side of the third dielectric body at a position directly above the slot.

12. The array antenna of claim 7, wherein the radiative elements of the plane antenna are arranged in units of pairs.

* * * * *